US010077763B2

(12) United States Patent
Glauber

(10) Patent No.: US 10,077,763 B2
(45) Date of Patent: Sep. 18, 2018

(54) AIR OPERATED PUMP

(71) Applicant: WILDEN PUMP AND ENGINEERING LLC, Grand Terrace, CA (US)

(72) Inventor: Carl Glauber, Mission Viejo, CA (US)

(73) Assignee: WILDEN PUMP AND ENGINEERING LLC, Grand Terrace, CA (US)

( * ) Notice: Subject to any disclaimer, the term of this patent is extended or adjusted under 35 U.S.C. 154(b) by 281 days.

(21) Appl. No.: 15/079,441

(22) Filed: Mar. 24, 2016

(65) Prior Publication Data

US 2017/0022983 A1 Jan. 26, 2017

Related U.S. Application Data

(60) Provisional application No. 62/138,180, filed on Mar. 25, 2015.

(51) Int. Cl.

| | |
|---|---|
| ***F04B 9/137*** | (2006.01) |
| ***F04F 5/20*** | (2006.01) |
| ***F04B 43/073*** | (2006.01) |
| ***F04B 9/12*** | (2006.01) |

(52) U.S. Cl.

CPC ..... *F04B 9/137* (2013.01); *F04B 9/12* (2013.01); *F04B 43/0736* (2013.01); *F04F 5/20* (2013.01)

(58) Field of Classification Search

CPC .. F04B 9/12; F04B 9/133; F04B 9/135; F04B 9/137; F04B 43/113; F04B 47/08; F01L 25/063; F01L 25/06; F01L 25/04; F04F 1/02

See application file for complete search history.

(56) References Cited

U.S. PATENT DOCUMENTS

| | | | | |
|---|---|---|---|---|
| 2,834,295 A * | 5/1958 | Hjarpe | F03C 1/035 417/344 |
| 3,071,118 A | 1/1963 | Wilden | |
| 3,555,966 A | 1/1971 | Coniglo | |
| 4,158,530 A | 6/1979 | Bernstein | |
| 4,247,264 A | 1/1981 | Wilden | |
| 4,549,467 A | 10/1985 | Wilden et al. | |
| 4,846,045 A | 7/1989 | Grach et al. | |
| 5,007,803 A | 4/1991 | DiVito | |
| 5,147,182 A * | 9/1992 | Timmons | F04B 43/113 417/234 |

(Continued)

OTHER PUBLICATIONS

U.S. Appl. No. 62/068,433, filed Oct. 24, 2014, Glauber.

*Primary Examiner* — Kenneth J Hansen
(74) *Attorney, Agent, or Firm* — Karish & Bjorgum, PC

(57) ABSTRACT

An air-driven pump includes a source of compressed air, a vacuum source including a venturi and two pump units with structurally independent pumping elements dividing pump chambers from air chambers. A directional control valve is in communication with the source of compressed air, the vacuum source, the pump unit air chambers. The directional control valve includes two valve positions alternating communication of the source of compressed air and the vacuum source with the air chambers. A pilot valve system shifts the directional control valve between the two valve positions at end of stroke positions of the pump and includes actuators extending into the air chambers to engage the pumping elements with the air chambers contracted.

6 Claims, 3 Drawing Sheets

(56) References Cited

U.S. PATENT DOCUMENTS

| | | | | |
|---|---|---|---|---|
| 5,169,296 | A | 12/1992 | Wilden | |
| 5,213,485 | A | 5/1993 | Wilden | |
| 5,349,895 | A | 9/1994 | Dicarlo | |
| 5,378,122 | A | 1/1995 | Duncan | |
| 5,957,670 | A | 9/1999 | Duncan et al. | |
| 6,102,363 | A | 8/2000 | Eberwein | |
| 6,257,845 | B1 | 7/2001 | Jack et al. | |
| 6,357,723 | B2 | 3/2002 | Kennedy et al. | |
| 6,435,845 | B1 | 8/2002 | Kennedy et al. | |
| RE38,239 | E | 8/2003 | Duncan | |
| 7,063,516 | B2 | 6/2006 | Bethel | |
| 7,125,229 | B2 | 10/2006 | Distaso et al. | |
| 7,399,168 | B1 | 7/2008 | Eberwein | |
| 7,452,166 | B2 | 11/2008 | Von Keudell | |
| 7,517,199 | B2 | 4/2009 | Reed et al. | |
| 8,047,222 | B2 | 11/2011 | Lent et al. | |
| 8,231,310 | B2 | 7/2012 | Sanwald | |
| 8,360,745 | B2 | 1/2013 | Dietzsch et al. | |
| 9,127,657 | B2 | 9/2015 | Glauber | |
| 2007/0122291 | A1* | 5/2007 | Okumura ..... | F04B 49/08<br>417/46 |
| 2014/0377086 | A1 | 12/2014 | Glauber | |
| 2015/0219089 | A1 | 8/2015 | Glauber et al. | |

* cited by examiner

AIR OPERATED PUMP

BACKGROUND OF THE INVENTION

The field of the present invention is air operated pumps. U.S. Pat. Nos. 8,360,745; 7,399,168; 7,063,516; RE38, 239; U.S. Pat. Nos. 6,435,845; 6,357,723; 6,257,845; 5,957, 670; 5,169,296; 4,247,264 disclose air driven and air controlled pumps. Actuator valves used in such pumps are also disclosed in the foregoing and are specifically addressed in U.S. Pat. Nos. 8,047,222; 7,125,229; 6,102,363; 4,549,467.

Conventional designs of the foregoing air-driven pumps include pump units, each including a pump chamber, an air chamber and a pumping member between the pump chamber and the air chamber. The pumping members are powered by alternating air pressure and venting to and from the air chamber to stroke back and forth to pump material through the pump chambers. These members may be pistons with annular seals sliding within a cylinder or diaphragms fixed about their periphery and attached to central pistons. U.S. Pat. No. 8,047,222 discloses a recent diaphragm with an integral rigid piston. The air-driven pumps typically have the air chambers to either side of an air valve to facilitate coupling the pumping members together by a shaft extending through the air valve and attached to the pistons.

The air valves for these pumps operate using pilot valve systems that sense pump position or other criteria and initiate shifting of directional control valves to alternate air pressure and venting to and from the air chambers. A pilot system shifting a directional control valve may use a pilot valve associated with the shaft attached to the pumping members to sense end of stroke. Alternatively, a valve may be associated with a pilot shaft, separate from the shaft attached to the pumping members, with probes extending into each air chamber. Another format may use separate valves, each with a probe extending into an air chamber, to provide the pilot function. Such pilot systems actuate the control valves through pressure surfaces on the control valve elements. Alternatively, a solenoid system or solenoid valve system driven by a timer or controller may be used. U.S. Pat. No. 5,378,122 discloses an air driven pump which is controlled by a solenoid that times shifts independently of the position of the pump in its cycle. U.S. Pat. No. 7,517,199 discloses an air driven pump which is controlled by an electronic controller.

The directional control valves of such systems which alternate air pressure and venting to and from the air chambers may be directly driven by an outside means, such as a solenoid, to shift between positions or may be pneumatically driven by a pilot valve such as discussed above. Two types of spool valves are common. One employs a balanced spool with equal piston areas to power the shifting. This type is disclosed in U.S. Pat. Nos. 4,549,467 and 6,102,363. A second common type employs an unbalanced spool with unequal piston areas to power the shifting. This type is disclosed in U.S. Pat. Nos. 7,125,229 and 8,047,222.

The disclosures of each of the aforementioned U.S. Patents in the above Background are incorporated herein by reference in their entireties.

SUMMARY OF THE INVENTION

The invention is directed to an air-driven pump having a source of compressed air, a vacuum source, multiple pump units and a directional control valve. Each pump unit includes a pump chamber, an air chamber, a pumping member between the pump chamber and the air chamber and an end of stroke position with the air chamber contracted. If there are more than two pump units, the pump units may be conveniently divided into two sets operating from the same directional control valve.

With the foregoing components, the vacuum source includes a venturi having an inlet port in communication with a source of compressed air, an outlet port to atmosphere and a venturi throat port. The directional control valve includes first and second valve positions of a valve element such as a spool and is in communication with the source of compressed air, the vacuum source at the venturi throat port and the multiple air chambers. The first valve position provides communication between the source of compressed air and the air chambers of the first set of pump units and communication between the vacuum source and the air chambers of the second set of pump units. The second valve position provides communication between the sources of compressed air and vacuum and the air chambers of the sets of pump units reversed from that of the first valve position. The directional control valve is shifted between valve positions at the end of stroke positions of each set of pump units. This configuration provides power for pumping through both pressure and vacuum. Further, a common source of shop air or other source of pressure may conveniently be used to provide control air to actuate the control valve and motive pressure and generated motive vacuum in the pump units.

The foregoing air-driven pump units do not require a shaft attached to the pumping members coupling them together as traditionally employed. When not so coupled, the pumping members are structurally independent from one another to move separately responsive to pressure and vacuum from the control valve. This arrangement allows delay of shifting until the sensed stroke position of one pumping member is reached, regardless of the position of the other pumping member. In the preferred embodiment, the movable member controlling the shift is the one drawn by vacuum to charge the pump chamber of one of the pump units.

Therefore, it is a principal object of the present invention to provide an improved vacuum assisted air driven pump. Other and further objects and advantages will appear hereinafter.

DETAILED DESCRIPTION OF THE PREFERRED EMBODIMENTS

Figure 1:
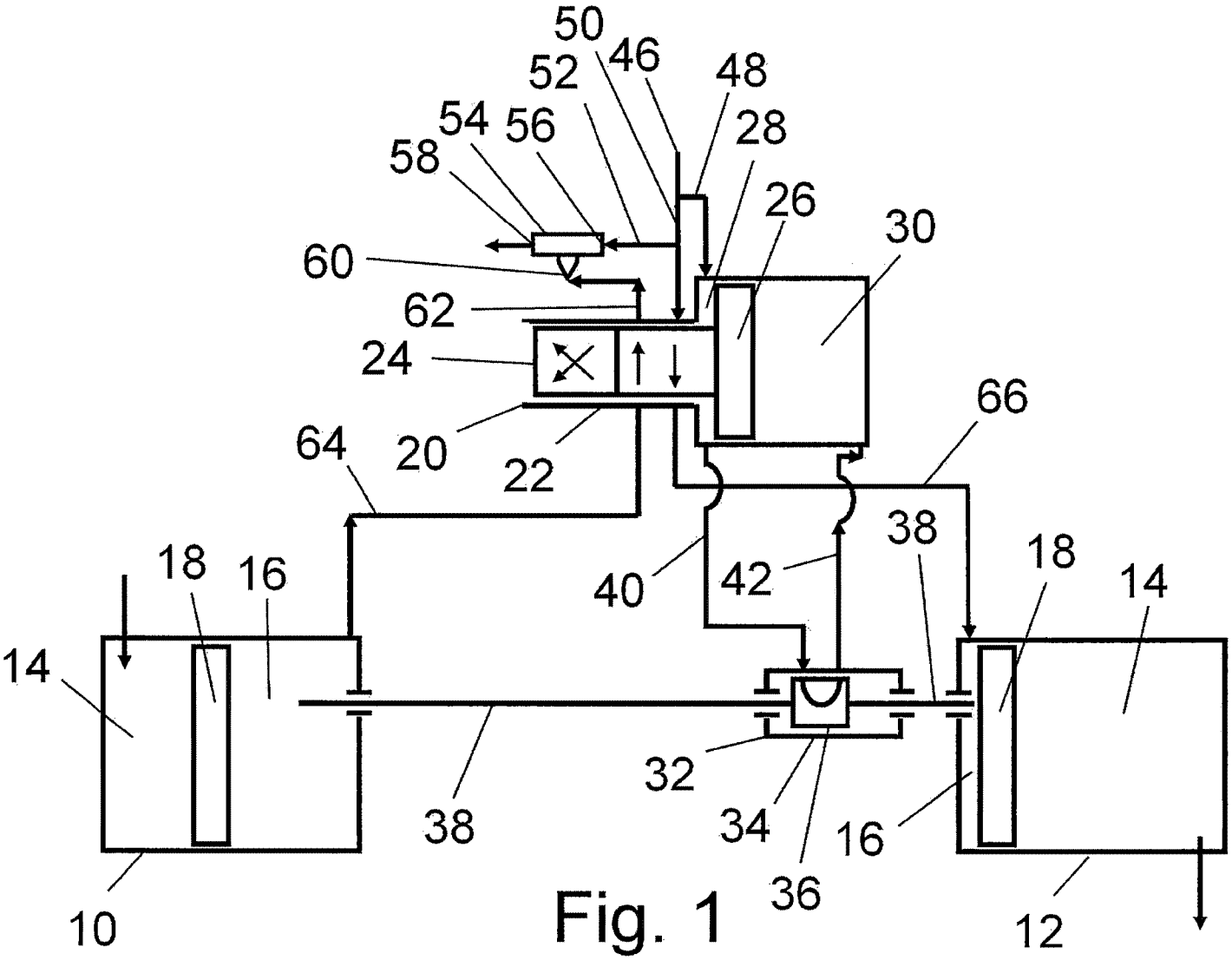
FIG. 1 is a schematic representation of an air operated pump with the control valve in a first position.

Turning in detail to the drawings, the Figures illustrate schematically an air driven pump. The pump includes two pump units 10, 12. Each pump unit 10, 12 includes a pump chamber 14, an air chamber 16 and a pumping member 18 dividing the pump unit into the two chambers. The pump chambers 14 pass pumped fluids therethrough while the air chambers 16 alternately receive pressurized motive air and vacuum to power the pumping members 18 to drive the pumped fluids through the pump chambers 14. The pump chambers 14 are controlled by one-way valves for both intake and exhaust, illustrated in the Figures when open by arrows into and out of the pump chambers 14.

The pumping members 18 are schematically illustrated in the Figures appearing as pistons moving within the pump units 10, 12. These pumping members 18 may be pistons with annular seals sliding within cylindrical chambers in each pump unit 10, 12. Alternatively, the pumping members 18 may be diaphragms in the pump units 10, 12 fixed about their periphery to flex back and forth in a pumping action under the influence of pressure and vacuum.

Figure 2:
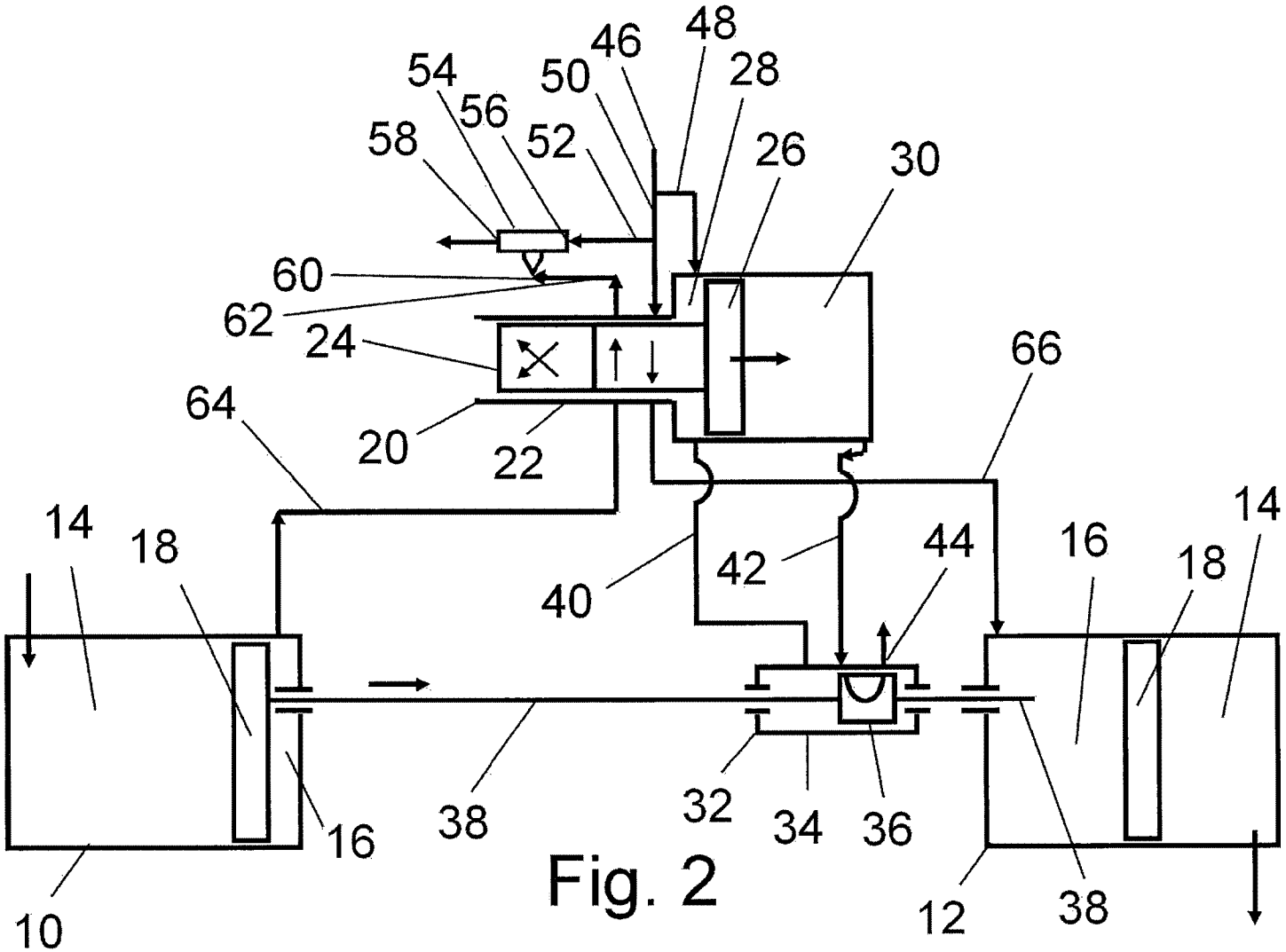
FIG. 2 is a schematic representation of the air operated pump of FIG. 1 with the control valve in transition from the first position to a second position.
Figure 3:
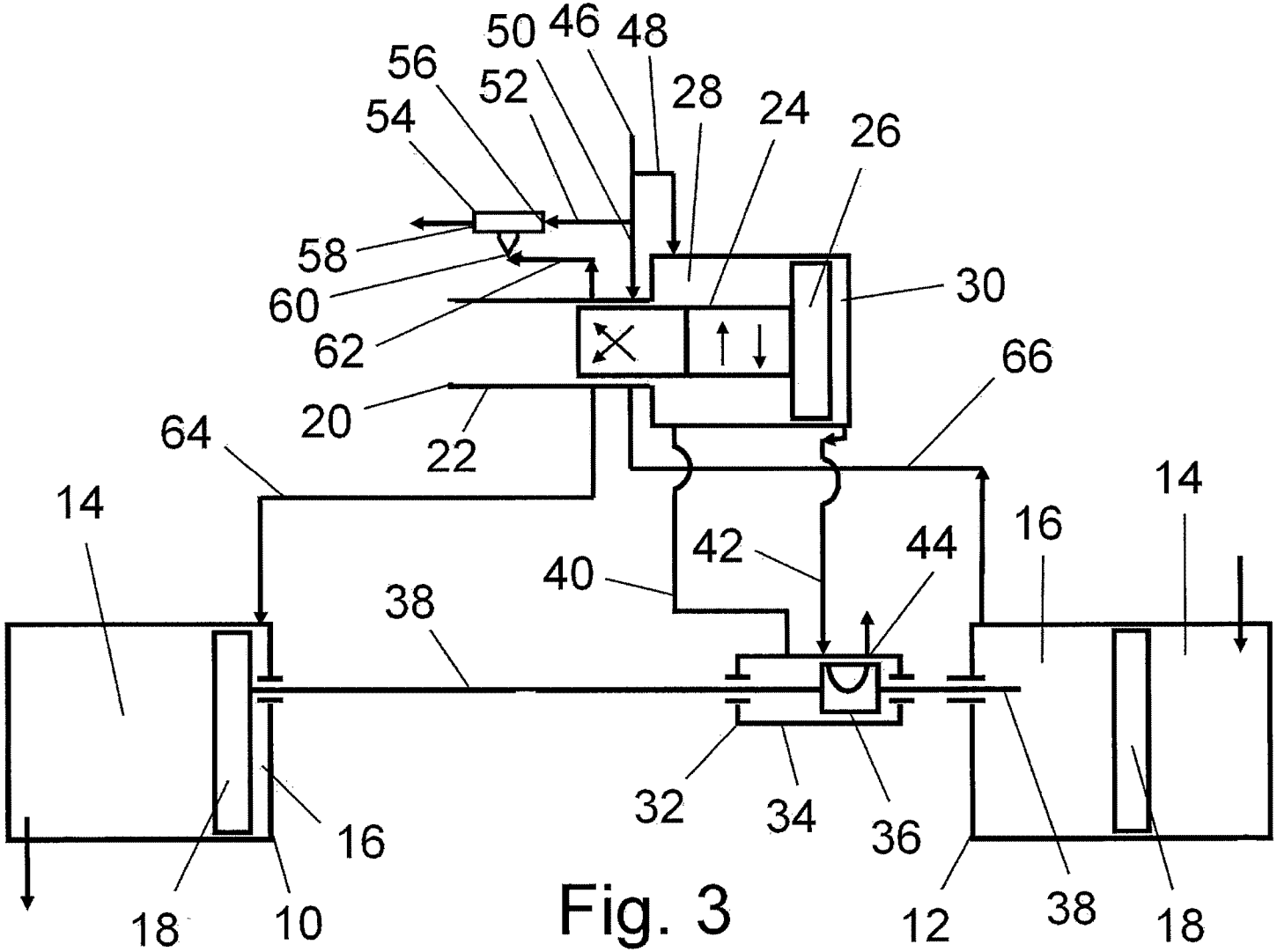
FIG. 3 is a schematic representation of the air operated pump of FIG. 1 with the control valve in the second position.

The air driven pump further includes a directional control valve 20. The directional control valve 20 may be of the balanced or unbalanced spool type. In the preferred embodiment, the directional control valve 20 is of the unbalanced spool type including a valve body 22 and a valve element 24. The valve element 24 is typically configured as a spool driven back and forth between two positions within the valve body 22. A first position of the valve element 24 is illustrated in FIG. 1 while a second position of the valve element 24 is illustrated in FIG. 3. FIG. 2 illustrates a transition between the two extreme positions. The valve element of the preferred embodiment includes a piston 26 accommodated at one end of the spool. The piston 26 is located within a cylinder divided by the piston 26 into two chambers 28, 30. The directional control valve 20 may be essentially conventional in its design.

The air driven pump further includes a pilot system which may drive the valve element 24 directly such as by solenoids or other electrical mechanisms, in which case the piston is not required. Alternatively, the valve element 24 may be driven indirectly through pneumatic pressure on the piston 26 as accomplished in the preferred embodiment. A conventional pilot valve 32 is schematically illustrated in the preferred embodiment as including a valve body 34 with a valve element 36 reciprocating within the valve body 34. Actuators 38 from either end of the valve element 36 extend into the air chambers 16 of the pump units 10, 12, respectively. As with the directional control valve 20, the valve element 36 may be driven by solenoids or other electrical mechanisms.

The pilot valve 32 includes three ports. A first port is in communication through a passage 40 with the chamber 28 to one side of the piston 26 of the valve element 24. A second passage 42 is in communication with the chamber 30 to the other side of the piston 26. An exhaust port 44 vents to atmosphere. The valve element 36 can move between a first position to communicate the passages 40, 42 with one another and a second position communicating the passage 42 with the exhaust port. The directional control valve 20 and pilot system may incorporate the anti-stall mechanism in U.S. patent application Ser. No. 14/921,906 filed Oct. 23, 2015, the disclosure of which in its entirety is incorporated herein by reference.

A source of compressed air 46 provides motive and control air to the air driven pump. Control air is directed from the source of compressed air 46 to the chamber 28 of the directional control valve 20 through a passage 48. Motive air from the source of compressed air 46 is directed to the directional control valve 20 through a passage 50. The source of compressed air 46 also directs motive air through a passage 52 to a vacuum source provided by a venturi 54. The venturi 54 includes an inlet port 56 in communication with the passage 52 to receive pressurized air from the source of compressed air 46. An outlet port 58 from the venturi 54 is continuously open to atmosphere. The vacuum source at a venturi throat port 60 is in communication with the directional control valve 20 through a passage 62. Further, the air chambers 16 of the pump units 10, 12 are also in communication with the directional control valve 20 through passages 64, 66. An efficiency valve such as disclosed in U.S. Pat. No. 9,127,657 may be incorporated in the pump as part of the source of compressed air 46. The disclosure of this patent in its entirety is incorporated herein by reference.

In operation, inlet motive air is provided from the source of compressed air 46. This air may be shop air, air from a compressor or the like. In FIG. 1, the pumping members 18 are beginning to stroke toward the right. The valve element 24 is shown to be at a first position. In this position, the inlet motive air is directed through the passage 66 to the air chamber 16 of the pump unit 12. This forces the pumping member 18 in the pump unit 12 to move to the right under pressure accumulating in the adjacent air chamber 16. This in turn forces pumped fluids from the pump chamber 14 through the one-way valve. Concurrently, the air chamber 16 of the pump unit 10 is in communication with the venturi throat port 60 through the directional control valve 20 and the passages 62, 64. Inlet motive air from the source of compressed air 46 is directed through the inlet port 56 of the venturi 54 to exhaust through the outlet port 58. The vacuum generated in the venturi throat port 60 draws air from the air chamber 16 of the pump unit 10 through the passages 62, 64 to in turn draw the pumping member 18 in the pump unit 10 toward the right in FIG. 1. Pumped fluid is drawn into the pump chamber 14 in the pump unit 10 by the movement of the pumping member 18 therein.

The control air entering through the passage 48 to the chamber 28 pressurizes that chamber and passes therethrough and through the passage 40 to the pilot valve 32. In FIG. 1 the pilot valve is shown positioned to return the pressurized control air to the chamber 30 through the passage 42. Thus, pressure is built up in both chambers 28, 30. As the valve element 24 has a larger pressure surface on the side of the piston 26 facing the chamber 30 than on the side of the piston 26 facing the chamber 28, the valve element 24 is retained in the left position. With the valve element 24 in this position, flow continues to pressurize the air chamber 16 in the pump unit 12 and power vacuum through the venturi 54 to reduce pressure within the air chamber 16 of the pump unit 10.

As the pumping member 18 in the pump unit 10 approaches the end of stroke with the adjacent air chamber 16 contracted, the actuator 38 extending into the air chamber 16 of the pump unit 10 is forced to the right in the transition seen in FIG. 2. The movement of this actuator 38 ultimately moves the valve element 36 of the pilot valve 32 to the right such that the valve element 36 exhausts the chamber 30 through the passageway 40 and the exhaust port 42. As pressure in the chamber 30 is reduced, the force of the air pressure in the chamber 28 moves the valve element 24 to the right. This movement of the valve element 24 to the right continues until a second valve position is reached as seen in FIG. 3.

In this second valve position of the directional control valve 20, the inlet motive air from the source of compressed air 46 is now directed through the passage 64 to the air chamber 16 of the pump unit 10. As this air chamber 16 begins to fill, the pumping member 18 of the pump unit 10 is forced toward the left to expel fluid from the adjacent pump chamber 14. Concurrently, air in the air chamber 16 of the pump unit 12 is drawn through the passage 66 and the passage 62 to the venturi throat port 60. The inlet motive air to the venturi 54 continues to flow through the inlet port 56 to the outlet port 58 to induce vacuum at the venturi throat port 60 to generate a vacuum within the air chamber 16 of the second pump unit 12. Thus, the pumping member 18 of the pump unit 12 moves to contract the adjacent air chamber 16 as the air chamber 16 of the pump unit 10 is expanding. This pumping stroke continues until the actuator 38 extending into the pump unit 12 engages the pumping member 18 of the pump unit 12 as the air chamber 16 contracts. Ultimately, the pilot valve 32 is returned to the position as shown in FIG. 1 to initiate a shifting of the valve element 24 of the directional control valve 20 to the position as illustrated in FIG. 1.

In the embodiment illustrated in FIGS. 1 through 3, there is no structural connection between the pumping members 18 in the pump units 10, 12. Thus, the two pumping members 18 can move independently of one another. As the actuators 38 are located on the air chamber sides of the pumping members 18 of each pump unit 10, 12, the pump is given to shift as the pumping members 18 reach end of stroke positions with the air chambers contracted. The end of stroke timing, with the pumping members 18 not structurally connected, leaves the pump stroke of the pumping members 18 indeterminate and responsive to the output head and outlet flow conditions of the pumped fluid. The timing on the suction stroke is determined by the suction head and intake flow conditions. If the actuators 38 are located on the pump chamber side of the pumping members, then the timing is on the pumping stroke and determined by the output head and outlet flow conditions of the pumped fluid. In this arrangement, the suction stroke is indeterminate and responsive to the suction head and intake flow conditions. Alternatively, the pumping members 18 can be structurally tied together in conventional fashion and the pressure and vacuum strokes will experience identical timing and stroke length; and the two forces will work cumulatively in powering each stroke.

Thus, an air driven pump is disclosed which employs motive vacuum in conjunction with motive pressure to power an air driven pump. While embodiments and applications of this invention have been shown and described, it would be apparent to those skilled in the art that many more modifications are possible without departing from the inventive concepts herein.

What is claimed is:

1. An air-driven pump comprising:

a source of compressed air;

a vacuum source including a venturi having an inlet port in communication with the source of compressed air, an outlet port to atmosphere and a venturi throat port;

a first pump unit including a first pump chamber, a first air chamber and a first pumping member between the first pump chamber and the first air chamber;

a second pump unit including a second pump chamber, a second air chamber and a second pumping member between the second pump chamber and the second air chamber;

a directional control valve in communication with the source of compressed air, the vacuum source, the first air chamber and the second air chamber, the directional control valve including a first valve position with communication between the source of compressed air and the first air chamber and with communication between the venturi throat port and the second air chamber and a second valve position with communication between the source of compressed air and the second air chamber and with communication between the venturi throat port and the first air chamber.

2. The air driven pump of claim 1, movement of the first pumping member being structurally independent of movement of the second pumping member.

3. The air driven pump of claim 1 further comprising a pilot valve system shifting the directional control valve between the first and second valve positions, the first pump unit further including a first end of stroke position with the first air chamber contracted and the second pump unit further including a second end of stroke position with the second air chamber contracted, the pilot valve system shifting the control valve from the second valve position to the first position when the pumping member of the first pump unit is in the first end of stroke position and shifting the control valve from the first valve position to the second valve position when the pumping member of the second pump unit is in the second end of stroke position.

4. The air driven pump of claim 3, movement of the first pumping member being structurally independent of movement of the second pumping member.

5. The air driven pump of claim 1, the first pump unit further including a first end of stroke position with the first air chamber contracted, the second pump unit further including a second end of stroke position with the second air chamber contracted, and further comprising a pilot valve system shifting the directional control valve between the first and second valve positions, the pilot valve system including a first actuator to shift the control valve from the second valve position to the first position when the pumping member of the first pump unit is in the first end of stroke position and a second actuator to shift the control valve from the first valve position to the second valve position when the pumping member of the second pump unit is in the second end of stroke position.

6. An air-driven pump comprising:

a source of compressed air;

a vacuum source including a venturi having an inlet port in communication with the source of compressed air, an outlet port to atmosphere and a venturi throat port;

a first pump unit including a first pump chamber, a first air chamber, a first pumping member between the first pump chamber and the first air chamber and a first end of stroke position with the first air chamber contracted;

a second pump unit including a second pump chamber, a second air chamber, a second pumping member between the second pump chamber and the second air chamber and; a second end of stroke position with the second air chamber contracted, movement of the first pumping member being structurally independent of movement of the second pumping member;

a directional control valve in communication with the source of compressed air, the vacuum source, the first air chamber and the second air chamber, the directional control valve including a first valve position with communication between the source of compressed air and the first air chamber and with communication between the venturi throat port and the second air chamber and a second valve position with communication between the source of compressed air and the second air chamber and with communication between the venturi throat port and the first air chamber;

a pilot valve system shifting the directional control valve between the first and second valve positions, the pilot valve system including a first actuator to shift the control valve from the second valve position to the first position when the pumping member of the first pump unit is in the first end of stroke position and a second actuator to shift the control valve from the first valve position to the second valve position when the pumping member of the second pump unit is in the second end of stroke position.

* * * * *